US010709943B2

(12) United States Patent
Maenaka et al.

(10) Patent No.: US 10,709,943 B2
(45) Date of Patent: Jul. 14, 2020

(54) IRON GOLF CLUB HEAD AND IRON GOLF CLUB

(71) Applicant: MIZUNO CORPORATION, Osaka (JP)

(72) Inventors: Kensuke Maenaka, Osaka (JP); Kazuhiro Doi, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 16/369,241

(22) Filed: Mar. 29, 2019

(65) Prior Publication Data

US 2019/0299069 A1 Oct. 3, 2019

(30) Foreign Application Priority Data

Mar. 29, 2018 (JP) ..... 2018-064447
Mar. 25, 2019 (JP) ..... 2019-056149

(51) Int. Cl.
*A63B 53/04* (2015.01)

(52) U.S. Cl.
CPC .. *A63B 53/0475* (2013.01); *A63B 2053/0412* (2013.01); *A63B 2053/0433* (2013.01); *A63B 2053/0445* (2013.01); *A63B 2053/0479* (2013.01)

(58) Field of Classification Search
USPC ..... 473/324–350
See application file for complete search history.

(56) References Cited

U.S. PATENT DOCUMENTS 5,421,577 A * 6/1995 Kobayashi ..... A63B 53/04 473/335
5,776,010 A * 7/1998 Helmstetter ..... A63B 53/04 473/334
6,695,712 B1 * 2/2004 Iwata ..... A63B 53/04 473/291
6,769,998 B2 * 8/2004 Clausen ..... A63B 53/0466 473/342
6,814,674 B2 * 11/2004 Clausen ..... A63B 53/0466 473/342
6,887,164 B2 * 5/2005 Dewanjee ..... A63B 53/047 473/342
6,981,924 B2 * 1/2006 Deshmukh ..... A63B 53/04 473/342

(Continued)

FOREIGN PATENT DOCUMENTS

JP 2002253712 A * 9/2002 ..... A63B 53/047
JP 2007151851 A * 6/2007
JP 2017-158927 A 9/2017

*Primary Examiner* — Alvin A Hunter
(74) *Attorney, Agent, or Firm* — Troutman Sanders LLP; James E. Schutz; Micah B. Hensley

(57) ABSTRACT

An iron golf club head includes: a face portion including a ball striking surface and a first reverse surface; and a sole back portion including a second reverse surface connected with the first reverse surface and located below the first reverse surface. The iron golf club head has a first hollow separated from outside by the face portion and the sole back portion. The ratio $W/V_1$ of the weight W (unit: g) of the iron golf club head relative to the volume $V_1$ (unit: $mm^3$) of the iron golf club head is $6.5\times10^{-3}$ or less. The sole maximum projected width Sw of the iron golf club head is 25 mm or more. The sweet spot height Sh of the iron golf club head is 20 mm or more.

15 Claims, 9 Drawing Sheets

(56) References Cited

U.S. PATENT DOCUMENTS

| | | | | |
|---|---|---|---|---|
| 6,991,559 | B2 * | 1/2006 | Yabu | A63B 53/04 473/332 |
| 7,144,336 | B2 * | 12/2006 | Reyes | A63B 53/0466 473/342 |
| 7,220,189 | B2 * | 5/2007 | Wieland | A63B 53/0466 473/342 |
| 7,232,380 | B2 * | 6/2007 | Nakahara | A63B 53/047 473/324 |
| 7,338,387 | B2 * | 3/2008 | Nycum | A63B 53/047 473/332 |
| 7,399,238 | B2 * | 7/2008 | Hocknell | A63B 53/0466 473/342 |
| 7,431,665 | B2 * | 10/2008 | Sugimoto | A63B 53/047 473/342 |
| 7,578,754 | B2 * | 8/2009 | Nakamura | A63B 53/047 473/342 |
| 8,376,878 | B2 * | 2/2013 | Bennett | A63B 53/0475 473/334 |
| 2004/0023730 | A1 * | 2/2004 | Nagai | A63B 53/04 473/345 |
| 2005/0130766 | A1 * | 6/2005 | Nakahara | A63B 53/047 473/349 |
| 2005/0164802 | A1 * | 7/2005 | Wood | A63B 53/0475 473/287 |
| 2005/0239570 | A1 * | 10/2005 | Best | A63B 53/047 473/292 |
| 2008/0318705 | A1 * | 12/2008 | Clausen | A63B 53/04 473/291 |
| 2016/0144248 | A1 * | 5/2016 | Chen | A63B 53/047 473/350 |
| 2017/0259133 | A1 | 9/2017 | Shimahara et al. | |

* cited by examiner

IRON GOLF CLUB HEAD AND IRON GOLF CLUB

This nonprovisional application is based on Japanese Patent Application No. 2018-064447 filed on Mar. 29, 2018 and Japanese Patent Application No. 2019-056149 filed on Mar. 25, 2019 with the Japan Patent Office, the entire contents of which are hereby incorporated by reference.

BACKGROUND OF THE INVENTION

Field of the Invention

The present invention relates to an iron golf club head and an iron golf club, particularly to an iron golf club head and an iron golf club with a loft angle of 40 degrees or more.

Description of the Background Art

In general, an iron golf club head with a loft angle of 40 degrees or more, such as a wedge, is used for shots from the bunker or rough. Such an iron golf club head is expected to glide smoothly at the time of a shot. In order to achieve smoothness of glide at the time of a shot, a sole should be prevented from digging into the ground. In order to achieve this, some of known iron golf clubs have a wide sole width.

Japanese Patent Laying-Open No. 2017-158927 discloses an iron-type golf club set including two or more iron-type golf clubs with different loft angles. In this set, a golf club with a greater loft angle has a wider sole width. In order to minimize the increase in head weight due to the increase in sole width, some of known heads have a cavity on its rear side.

Such an iron golf club head is also expected to have shot accuracy. Improvement in shot accuracy is achieved by, for example, heightening the sweet spot (SS) to easily give backspin to a ball and increase the amount of backspin. A ball with backspin is resistant to rolling after falling on the green or the like. Thus, a golfer can stop a ball at an intended place using an iron golf club head that can easily give backspin to a ball.

SUMMARY OF THE INVENTION

However, in the case of an iron golf club head having an increased sole width with a cavity structure, as the sole width increases, the position of the center of gravity of the iron golf club head shills to the sole side, and the height of the sweet spot decreases. Therefore, it is difficult for a conventional iron golf club head to achieve both smoothness of glide at the time of a shot and improvement in shot accuracy.

A main object of the present invention is to provide an iron golf club head and an iron golf club which achieve both smoothness of glide at the time of a shot and improvement in shot accuracy.

An iron golf club head according to the present invention is an iron golf club head with a loft angle of 40 degrees or more. This iron golf club head includes: a face portion including a ball striking surface and a first reverse surface located opposite to the ball striking surface; and a sole back portion including a second reverse surface connected with the first reverse surface and located below the first reverse surface when the iron golf club head is placed on the horizontal plane in such a manner that each of the loft angle and lie angle of the iron golf club head is a predetermined angle. The iron golf club head has a first hollow separated from outside by the face portion and the sole back portion. The ratio $W/V_1$ of the weight W (unit: g) of the iron golf club head relative to the volume $V_1$ (unit: $mm^3$) of the iron golf club head is $6.5\times10^{-3}$ or less. The sole maximum width Sw of the iron golf club head is 25 mm or more. The sweet spot height Sh of the iron golf club head is 20 mm or more.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
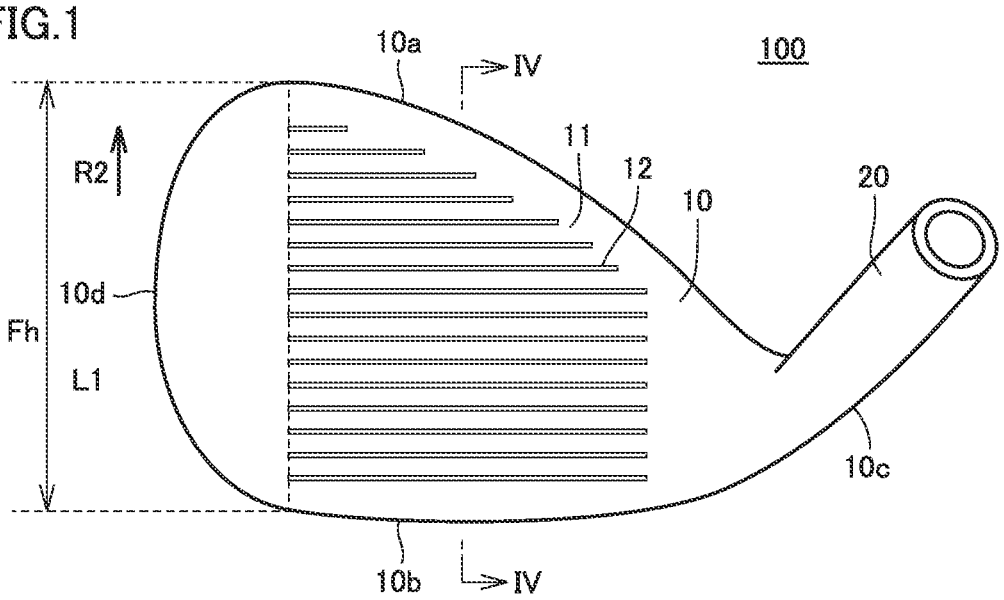
FIG. 1 is a front view of an iron golf club head according to embodiment 1.
Figure 2:
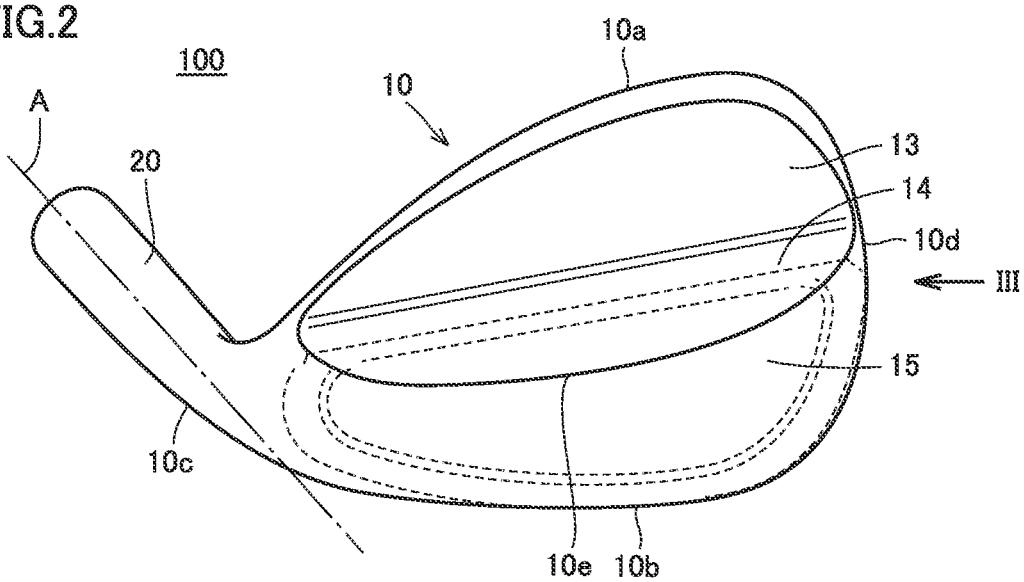
FIG. 2 is a rear view of the iron golf club head shown in FIG. 1.
Figure 3:
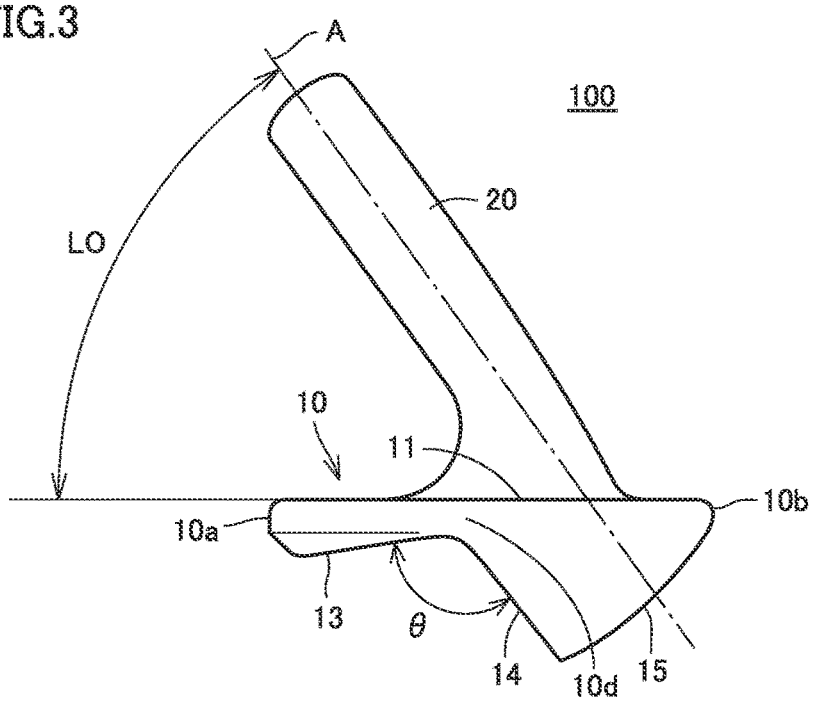
FIG. 3 is a side view of the iron golf club head shown in FIG. 1.

Embodiments of the present invention are hereinafter described with reference to the drawings. In the drawings, identical or corresponding parts are identically denoted, and the explanation of such parts is not repeated.

Embodiment 1

<Construction of Iron Golf Club Head>

Figure 4:
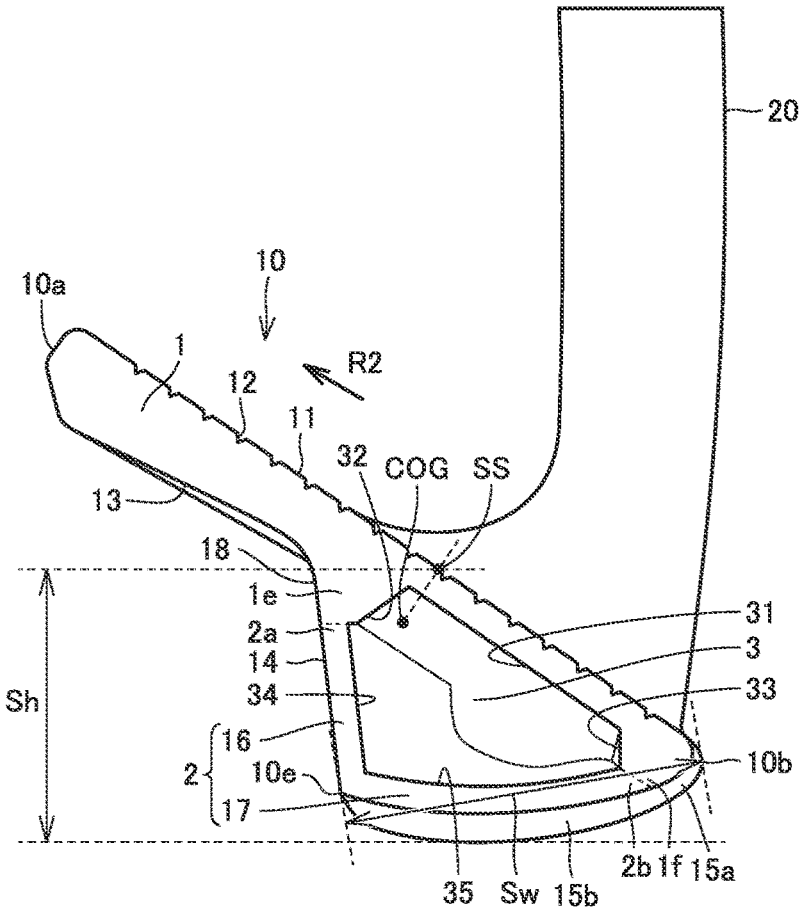
FIG. 4 is a cross-sectional view seen from line segment IV-IV in FIG. 1 and taken along the direction passing through the score line center and perpendicular to the score lines.

As shown in FIG. 1 to FIG. 5, an iron golf club head 100 according to embodiment 1 is a so-called wedge golf club with a loft angle Lo (see FIG. 3) of 40 degrees or more. Iron golf club head 100 includes a main body 10 including a face portion 1 and a sole back portion 2, and a hosel 20 to receive a shall. FIG. 4 is a cross-sectional view taken along the direction passing through the score line center and perpendicular to the score lines shown in FIG. 1.

As shown in FIG. 1 and FIG. 4, main body 10 includes a top edge 10*a*, a leading edge 10*b*, a heel 10*c*, a toe 10*d*, and a trailing edge 10*e*. Top edge 10*a* constitutes the upper end of main body 10 when iron golf club head 100 is placed on the horizontal plane in such a manner that each of the loft angle and lie angle of iron golf club head 100 is a predetermined angle (hereinafter referred as a "reference position"). Leading edge 10*b* constitutes the front end of main body 10 in the above-described reference position. The front and back of main body 10 respectively refer to the front and back in the forward direction of iron golf club head 100 when it is swung. Heel 10*c* connects the lower end of hosel 20 with sole back portion 2. Toe 10*d* connects sole back portion 2 with top edge 10*a*, opposite to heel 10*c*. Trailing edge 10*e* is located on the front side relative to top edge 10*a* and on the back side relative to leading edge 10*b* in the above-described reference position. Trailing edge 10*e* connects the lower end of a second reverse surface 14 (described later) with the back end of a second lower surface 15*b* (described later).

Figure 5:
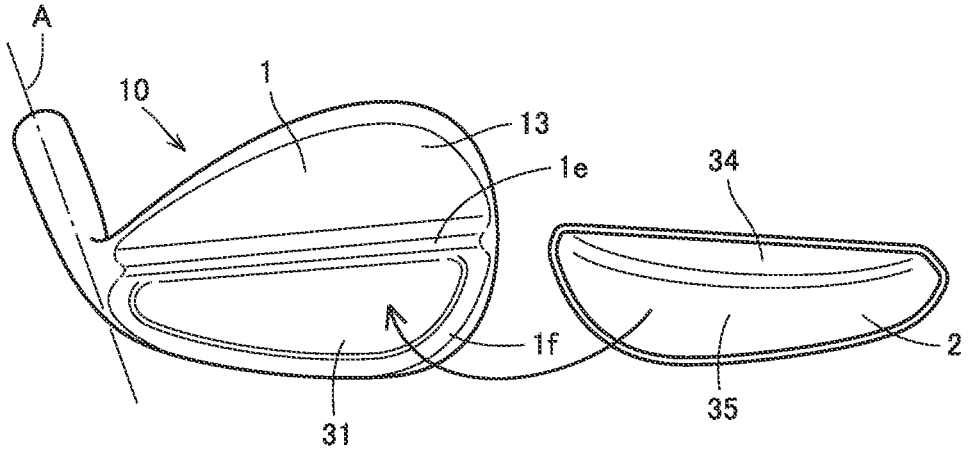
FIG. 5 is an exploded view for explaining one example of a hollow of an iron golf club head and a method for manufacturing the same according to embodiment 1.

As shown in FIG. 4 and FIG. 5, face portion 1 includes a ball striking surface 11 to strike a ball, and a first reverse surface 13 located opposite to ball striking surface 11. Sole back portion 2 includes a second reverse surface 14 connected with first reverse surface 13 and located below first reverse surface 13 when iron golf club head 100 is in the above-described reference position. Main body 10 has a first hollow 3 separated from outside by face portion 1 and sole back portion 2. In iron golf club head 100, first hollow 3 is located only between ball striking surface 11 and second reverse surface 14, but is not located between ball striking surface 11 and first reverse surface 13.

Ratio $W/V_1$ (unit: $g/mm^3$) of the weight W (unit: g) of iron golf club head 100 to the volume $V_1$ (unit: $mm^3$) of iron golf club head 100 is $6.5\times10^{-3}$ or less. This volume $V_1$ includes the volume $V_2$ of first hollow 3. Volume $V_1$ can be measured by, for example, putting iron golf club head 100 in water. Preferably, ratio $W/V_1$ is 6.0 or less.

The sole maximum width Sw of iron golf club head 100 is 25 mm or more. Sole maximum width Sw refers to the length of the line connecting leading edge 10*b* and trailing edge 10*e* on the section along the score line center shown in FIG. 4. Sole maximum width Sw can easily be measured using, for example, vernier calipers. Preferably, sole maximum width Sw is 27 mm or more.

The sweet spot height Sh of iron golf club head 100 (se FIG. 4) is 20 mm or more. Sweet spot height Sh is the height of sweet spot SS (see FIG. 4) relative to the above-described horizontal plane in the above-described reference position. Sweet spot SS is the intersection point between ball striking surface 11 and the perpendicular from the center of gravity COG of iron golf club head 100 (see FIG. 4) to ball striking surface 11. Preferably, sweet spot height Sh is 21 mm or more. More preferably, sweet spot height Sh is 23 mm or more.

The weight of iron golf club head 100 is not less than 280 g and not more than 330 g. particularly not less than 290 g and not more than 310 g. for example

Specific Example of Construction

Iron golf club head 100 may be manufactured by any method. For example, iron golf club head 100 may be manufactured by welding face portion 1 and sole back portion 2 produced by forging or casting. An example construction of iron golf club head 100 manufactured by such a method is hereinafter described with reference to FIG. 1 to FIG. 5.

Main body 10 mainly includes ball striking surface 11, first reverse surface 13, second reverse surface 14, a third reverse surface 18, and a lower surface 15, as the surfaces exposed to outside of main body 10. First reverse surface 13, second reverse surface 14, third reverse surface 18, and lower surface 15 are located opposite to ball striking surface 11. Further, main body 10 mainly includes a first inner periphery 31, a second inner periphery 32, a third inner periphery 33, a fourth inner periphery 34, and a fifth inner periphery 35, as the surfaces fronting on first hollow 3 but not exposed to outside of main body 10. Lower surface 15 is located below main body 10 in the above-described reference position. Lower surface 15 can touch the ground when striking a ball. Lower surface 15 comprises a first lower surface 15*a* included in face portion 1, and a second lower surface 15*b* included in sole back portion 2.

As shown in FIG. 1 to FIG. 4, face portion 1 includes ball striking surface 11, first reverse surface 13, third reverse surface 18, first lower surface 15*a*, first inner periphery 31, second inner periphery 32, and third inner periphery 33. Sole back portion 2 includes second reverse surface 14, second lower surface 15*b*, fourth inner periphery 34, and fifth inner periphery 35. Each of ball striking surface 11, first reverse surface 13, third reverse surface 18, first lower surface 15*a*, first inner periphery 31, second inner periphery 32, and third inner periphery 33; and second reverse surface 14, second lower surface 15*b*, fourth inner periphery 34, and fifth inner periphery 35 extends in the direction from heel 10*c* toward toe 10*d* (hereinafter referred to as a "first direction"). The part of face portion 1 that is between ball striking surface 11 and first reverse surface 13 is solid.

As shown in FIG. 1 to FIG. 4, first reverse surface 13, third reverse surface 18, first lower surface 15*a*, first inner periphery 31, second inner periphery 32, and third inner periphery 33 are located opposite to ball striking surface 11. First reverse surface 13 is located between top edge 10*a* and a first protrusion 1*e* (described later). First reverse surface 13 connects with ball striking surface 11 via top edge 10*a*. First reverse surface 13 is located on the upper and back side relative to first inner periphery 31, second inner periphery 32, and third inner periphery 33. Third reverse surface 18 is located between first reverse surface 13 and second reverse surface 14. First lower surface 15*a* faces the above-described horizontal plane in the above-described reference position. First lower surface 15*a* touches the ground at the time of a shot. First lower surface 15*a* connects with ball striking surface 11 via leading edge 10*b*. First inner periphery 31 is surrounded by first protrusion 1*e* (described later) and a second protrusion 1*f* (described later). Second inner periphery 32 is located opposite to third reverse surface 18 across first protrusion 1*e* (described later). Third inner periphery 33 is located opposite to first lower surface 15*a* across second protrusion 1*f* (described later).

As shown in FIG. 1, ball striking surface 11 has a plurality of grooves (score lines) 12. Each of the plurality of score lines 12 linearly extends in the first direction. The plurality of score lines 12 are spaced at intervals in the direction R2 from leading edge 10*b* toward top edge 10*a* (hereinafter referred to as a "second direction").

As shown in FIG. 4 and FIG. 5, face portion 1 further includes first protrusion 1*e* and second protrusion 1*f*. First protrusion 1*e* and second protrusion 1*f* constitute one ring when seen from the direction perpendicular to ball striking surface 11.

As shown in FIG. 4 and FIG. 5, first protrusion 1*e* protrudes relative to first reverse surface 13 and first inner periphery 31. First protrusion 1*e* separates first reverse surface 13 from first inner periphery 31. First protrusion 1*e* includes the above-described second inner periphery 32 and the above-described third reverse surface 18. Third reverse surface 18 is, for example, in the same plane as second reverse surface 14.

As shown in FIG. 4 and FIG. 5, in the above-described reference position, first protrusion 1*e* is located above second protrusion 1*f*. First protrusion 1*e* extends, for example, linearly in the first direction. The height of first protrusion 1*e* relative to first inner periphery 31 is higher than the height of second protrusion 1*f* relative to first inner periphery 31.

First protrusion 1*e* is located between top edge 10*a* and leading edge 10*b* in the second direction.

As shown in FIG. 4 and FIG. 5, second protrusion 1*f* protrudes relative to first inner periphery 31 and is continuous with first protrusion 1*e* Second protrusion 1*f* connects with one end of first protrusion 1*e* on the heel 10*c* side, and connects with the other end of first protrusion 1*e* on the toe 10*d* side. Second protrusion 1*f* includes the above-described third inner periphery 33 and the above-described first lower surface 15*a*. First lower surface 15*a* is, for example, in the same plane as second lower surface 15*b*.

As shown in FIG. 1 to FIG. 4, second reverse surface 14 of sole back portion 2 is located between first reverse surface 13 and second lower surface 15*b* Second lower surface 15*b* is located between second reverse surface 14 and first lower surface 15*a*. Second lower surface 15*b* is in the same plane as first lower surface 15*a*. Fourth inner periphery 34 is located opposite to second reverse surface 14. Fifth inner periphery 35 is located opposite to second lower surface 15*b*. Leading edge 10*b* connects the lower end of ball striking surface 11 with the front end of second lower surface 15*b* in the above-described reference position. Trailing edge 10*e* connects the lower end of second reverse surface 14 with the back end of second lower surface 15*b* in the above-described reference position.

From a different point of view, sole back portion 2 includes a back portion 16 having second reverse surface 14 and fourth inner periphery 34, and a sole portion 17 having second lower surface 15*b* and fifth inner periphery 35. Back portion 16 and sole portion 17 are formed as one piece, for example. The boundary between back portion 16 and sole portion 17 constitutes trailing edge 10*e*. Back portion 16 includes a part located on the back and upper side relative to sole portion 17 in the above-described reference position. In the above-described reference position, the lower end of back portion 16 connects with the back end of sole portion 17. In the above-described reference position, the upper end of back portion 16 joins to first protrusion 1*e* of face portion 1. For example, the upper end surface of back portion 16 joins to the top surface of first protrusion 1*e* that connects the above-described second inner periphery 32 with the above-described third reverse surface 18. In the above-described reference position, the front end of sole portion 17 joins to second protrusion 1*f* of face portion 1. For example, the front end surface of sole portion 17 joins to the top surface of second protrusion 1*f* that connects the above-described third inner periphery 33 with the above-described first lower surface 15*a*.

As shown in FIG. 4, second inner periphery 32 connects first inner periphery 31 with fourth inner periphery 34. Third inner periphery 33 connects first inner periphery 31 with fifth inner periphery 35. The cross-sectional shape of first hollow 3 seen perpendicularly to the first direction is, for example, a pentagon.

As shown in FIG. 4, the thickness of the part of face portion 1 located between first protrusion 1*e* and second protrusion 1*f* is smaller than the thickness of the part of face portion 1 located on the top edge 10*a* side relative to first protrusion 1*e*. In other words, the distance between ball striking surface 11 and first inner periphery 31 is shorter than the distance between ball striking surface 11 and first reverse surface 13. The thickness of each of back portion 16 and sole portion 17 is smaller than the thickness of the part of face portion 1 located on the top edge 10*a* side relative to first protrusion 1*e*. In other words, the distance between second reverse surface 14 and fourth inner periphery 34 and the distance between second lower surface 15*b* and fifth inner periphery 35 are shorter than the distance between ball striking surface 11 and first reverse surface 13. The thickness of back portion 16 is, for example, equal to the thickness of sole portion 17.

The thickness of the part of face portion 1 located between first protrusion 1*e* and second protrusion 1*f* is, for example, not less than 2.0 mm and not more than 4.0 mm. The thickness of the part of face portion 1 located on the top edge 10*a* side relative to first protrusion 1*e* is, for example, not less than 4.0 mm and not more than 10.0 mm. The thickness of back portion 16 is, for example, not less than 1.5 mm and not more than 4.5 mm. The thickness of sole portion 17 is, for example, not less than 1.5 mm and not more than 4.5 mm.

As shown in FIG. 4, the thickness of the part of face portion 1 located between first protrusion 1*e* and second protrusion 1*f* is, for example, uniform in the second direction. In other words, in the above-described reference position, the angle of ball striking surface 11 relative to the horizontal plane is, for example, equal to the angle of first inner periphery 31 relative to the horizontal plane. The thickness of the part of face portion 1 located on the top edge 10*a* side relative to first protrusion 1*e* gradually decreases from the top edge 10*a* toward first protrusion 1*e*, for example. In other words, in the above-described reference position, the angle of ball striking surface 11 relative to the horizontal plane is, for example, greater than the angle of first reverse surface 13 relative to the horizontal plane. In the direction perpendicular to ball striking surface 11, the distance between ball striking surface 11 and trailing edge 10*c* is longer than the maximum distance between ball striking surface 11 and first reverse surface 13.

An extension A of the central axis of hosel 20 intersects heel 10*c*. The distance between extension A of the central axis of hosel 20 and the part of second protrusion 1*f* located on the heel 10*c* side is the shortest distance between extension A of the central axis of hosel 20 and second protrusion 1*f*. The shortest distance between extension A of the central axis of hosel 20 and second protrusion 1*f* is, for example, 5 mm or more.

First protrusion 1*e* of face portion 1 and back portion 16 of sole back portion 2 are, for example, welded together. Second protrusion 1*f* of face portion 1 and sole portion 17 of sole back portion 2 are, for example, welded together. Examples or material constituting face portion 1 include titanium (Ti), managing steel, stainless steel, and carbon steel. Examples of material constituting sole back portion 2 include titanium (Ti), managing steel, stainless steel, and carbon steel.

Preferably, volume $V_2$ of first hollow 3 is 18000 $mm^3$ or less. Preferably, volume $V_2$ of first hollow 3 is 10000 $mm^3$ or more.

Preferably, ratio Sh/Fh of sweet spot height Sh (unit: mm) relative to the maximum value Fh (unit: mm) of the face height of face portion 1 is 0.33 or more. Maximum value Fh of the face height of face portion 1 is the maximum value of the length of face portion 1 in second direction R2 measured along ball striking surface 11. Specifically, maximum value Fh of the face height of face portion 1 is the length of face portion 1 measured along ball striking surface 11 at the extreme end of score lines 12 adjacent to toe 10*d*. Maximum value Fh of the face height is preferably, but is not limited to, not less than 55 mm and not more than 64 mm.

Preferably, the angle θ (see FIG. 3) formed by first reverse surface 13 and second reverse surface 14 is 100 degrees or more. More preferably, angle θ (see FIG. 3) is 150 degrees or less.

Figure 6:
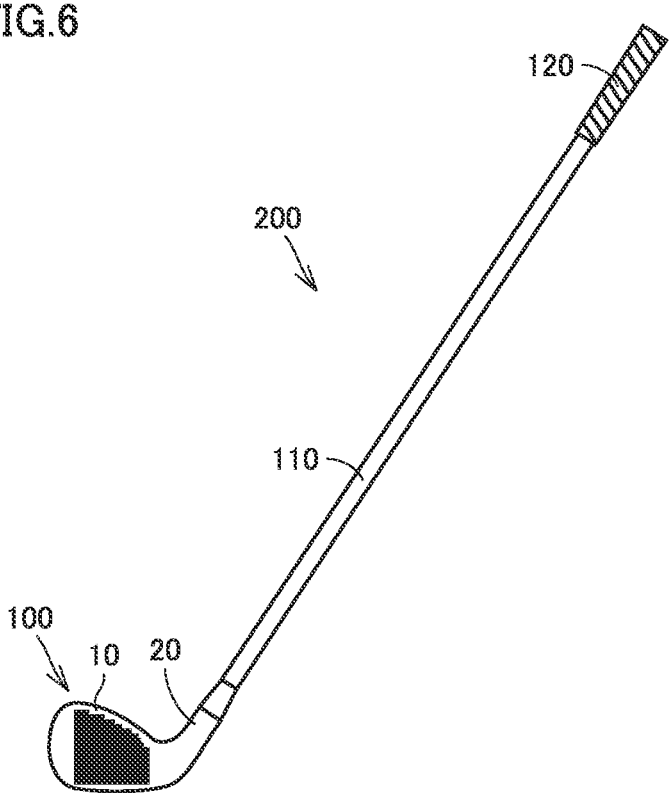
FIG. 6 is a view showing an iron golf club according to embodiment 1.

As shown in FIG. 6, an iron golf club 200 includes the above-described iron golf club head 100, a shaft 110, and a grip 120. Shaft 110 has one end and the other end. Iron golf club head 100 is attached to the above-described one end of shaft 110. Grip 120 is attached to the above-described other end of shaft 110.

Advantageous Effects

For a plurality of iron golf club heads having the above-described sole maximum width of 22 mm or more and having a cavity structure, the inventors evaluated ratio $W/V_1$ of weight W (unit: g) of each iron golf club head relative to its volume $V_1$ (unit: $mm^3$). The inventors confirmed that the above-described ratios $W/V_1$ of all the heads were $7.43\times10^{-1}$ or more (se the examples described later). As used herein, the cavity structure refers to a structure in which the central part of the reverse surface located opposite to the ball striking surface is recessed relative to the periphery of the reverse surface.

On the other hand, iron golf club head 100 has ratio $W/V_1$ of $6.5\times10^{-1}$ or less and sweet spot height Sh of 20 mm or more, while having sole maximum width Sw of 25 mm or more.

The above-described iron golf club head 100 has a relatively large volume due to its sole portion with a relatively large width. However, an increase in weight of iron golf club head 100 is minimized because a part of its volume is composed of first hollow 3. Therefore, iron golf club head 100 glides smoothly at the time of a shot and is easy to use.

Further, unlike an iron golf club head having a cavity structure, iron golf club head 100 includes sole back portion 2 that separates first hollow 3 from outside, and particularly includes back portion 16 having the above-described second reverse surface 14. Back portion 16 is located on the back and upper side relative to sole portion 17 in the above-described reference position. Accordingly, iron golf club head 100 can be designed to have sweet spot height Sh of 20 mm or more without increasing maximum value Fh of the face height of face portion 1 (described later) or without adding weight to the top edge 10*a* side of face portion 1. Sweet spot height Sh of iron golf club head 100 is higher than that of an iron golf club head having a cavity structure with no sole back portion 2. As a result, iron golf club head 100 can increase the amount of backspin as compared to the above-described iron golf club head having a cavity structure.

That is, when the ball striking position on ball striking surface 11 is lower than (on the leading edge 10*b* side relative to) the position of the center of gravity of iron golf club head 100 at the time of a shot, leading edge 10*b* rotates backward about the position of the center of gravity of iron golf club head 100. Further, iron golf club head 100 gives backspin to the ball in the direction opposite to the backward rotation, due to the "gear effect". As described above, the region of ball striking surface 11 located below sweet spot SS is larger in iron golf club head 100 than in the iron golf club head having a cavity structure. Accordingly, iron golf club head 100 can more easily give backspin to a ball than the iron golf club head having a cavity structure. When a ball is struck with iron golf club head 100 and with the iron golf club head having a cavity structure under the same conditions (i.e., their ball striking positions relative to the above-described horizontal plane is at the same height), the distance between the ball striking position and sweet spot SS of iron golf club head 100 is longer than that of the iron golf club head having a cavity structure. Thus, iron golf club head 100 can achieve a higher gear effect and a larger amount of backspin than the above-described conventional iron golf club head.

That is, as compared to the iron golf club head having a cavity structure where the sole maximum width is 22 mm or more and the above-described ratio is $7.43\times10^{-3}$ or more, iron golf club head 100 can achieve at least one of the weight reduction of main body 10 and the increase in the amount of backspin, while being as good as or better than the above-described iron golf club head in smoothness of glide at the time of a shot. Thus, iron golf club head 100 is improved in shot accuracy, while being as good as or better than the above-described iron golf club head in smoothness of glide at the time of a shot.

Preferably, volume $V_2$ of first hollow 3 is 18000 $mm^3$ or less. Preferably, volume $V_2$ of first hollow 3 is 10000 $mm^3$ or more. With such a first hollow 3, iron golf club head 100 can be easily designed to have $W/V_1$ of $6\ 5\times10^{-3}$ or less and sole maximum width Sw of 25 mm or more.

Preferably, ratio Sh/h of sweet spot height Sh (unit: mm) relative to maximum value Fh (unit: mm) of the face height or face portion 1 is 0.33 or more. Maximum value Fh of the face height of face portion 1 is the maximum value of the height of face portion 1 measured along ball striking surface 11. Specifically, maximum value Fh of the face height of face portion 1 is the height of face portion 1 measured along ball striking surface 11 at the extreme end of score lines 12 adjacent to toe 10*d*.

Such an iron golf club head 100 can be designed to have sweet spot height Sh of 20 mm or more without increasing maximum value Fh or the face height of face portion 1 or without adding weight to the top edge 10*a* side of face portion 1. For example, in order to minimize the increase in weight of main body 10 while increasing maximum value Fh of the face height of face portion 1, face portion 1 and sole back portion 2 of main body 10 should be reduced in thickness. This, however, undermines the durability of main body 10. Unlike this, iron golf club head 100 can be designed to have sweet spot height Sh of 20 mm or more without increasing maximum value Fh of the face height of face portion 1. Thus, iron golf club head 100 is improved in shot accuracy while having high durability.

Preferably, angle θ (see FIG. 3) formed by first reverse surface 13 and second reverse surface 14 is 100 degrees or more. More preferably, angle θ (see FIG. 3) is 150 degrees or less. That is, angle θ of iron golf club head 100 is greater than that of a head having a "cavity structure" Accordingly, as compared to an iron golf club head having a cavity structure, iron golf club head 100 can be designed to have a greater sole maximum width while having equal or higher sweet spot height Sh.

In iron golf club head 100, first protrusion 1*e* is located on the reverse of the ball striking portion. Thus, as compared to an iron golf club head in which a part of first hollow 3 is located on the top edge 10*a* side relative to the center of face portion 1 in the second direction, iron golf club head 100 can reduce undesired bending of the ball striking surface when striking a ball, and can improve the feel of striking.

Embodiment 2

Figure 7:
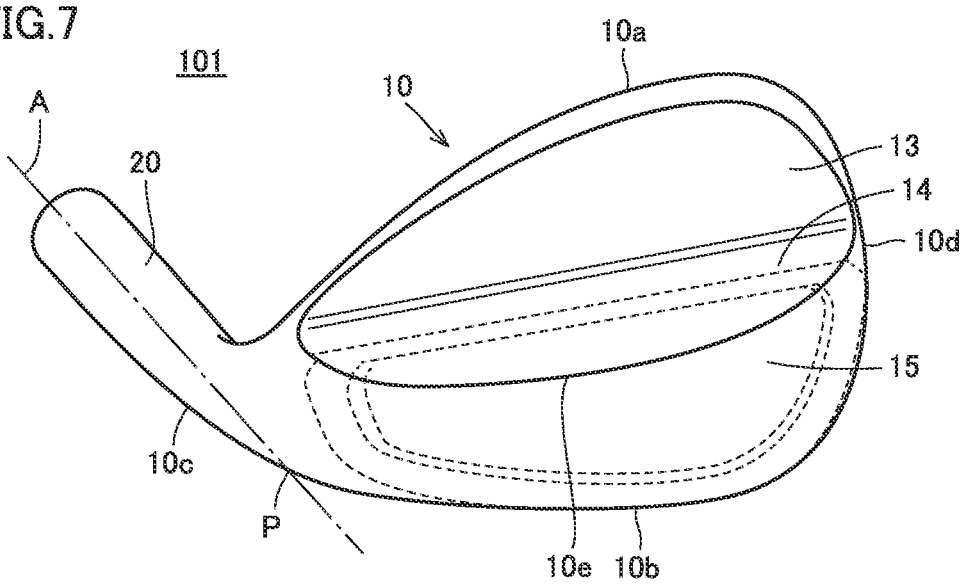
FIG. 7 is a rear view of an iron golf club head according to embodiment 2.
Figure 8:
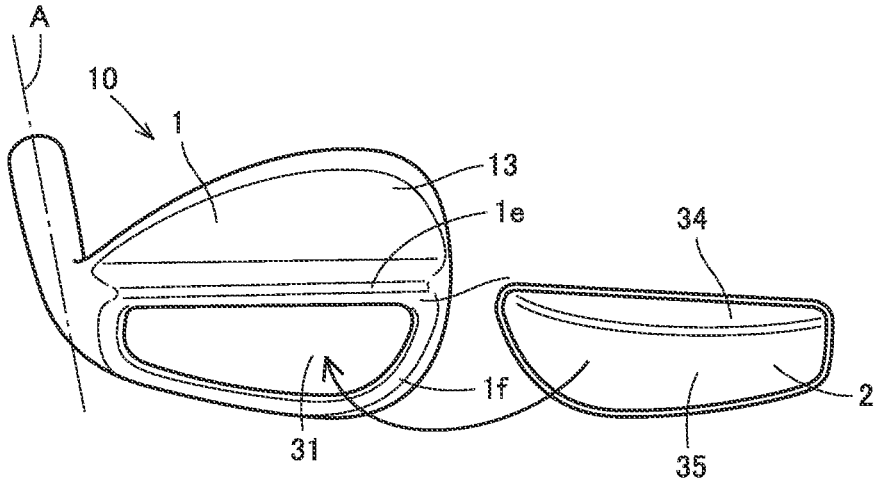
FIG. 8 is an exploded view for explaining one example of a hollow of an iron golf club head and a method for manufacturing the same according to embodiment 2.
Figure 9:
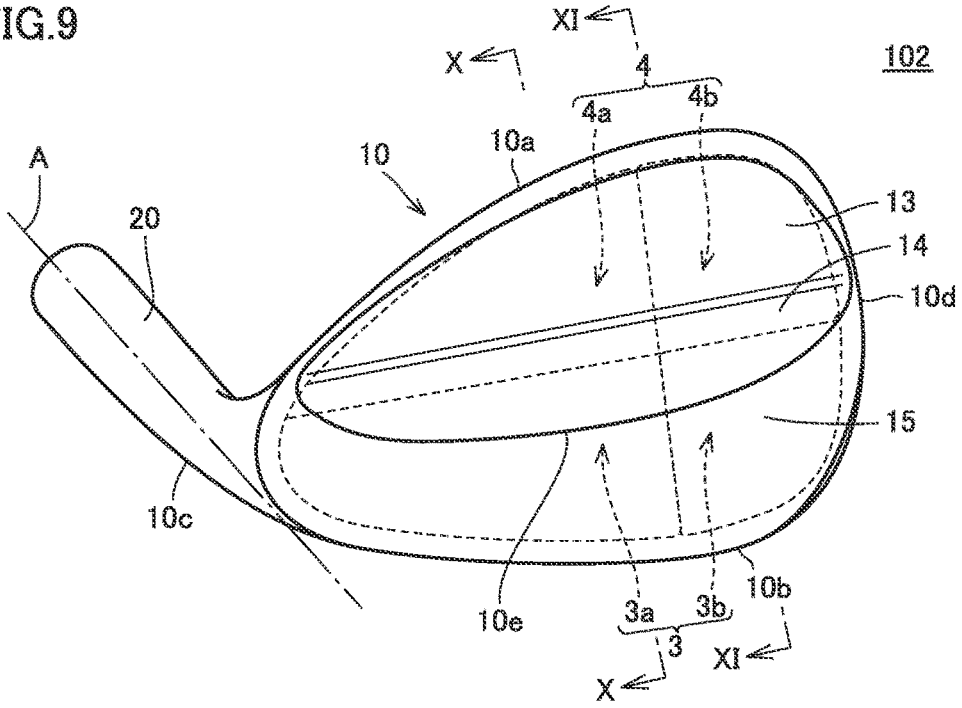
FIG. 9 is a rear view of an iron golf club head according to embodiment 3.

As shown in FIG. 7 and FIG. 8, an iron golf club head 101 according to embodiment 2 has a construction basically similar to that of iron golf club head 100 according to embodiment 1. However, iron golf club head 101 is different from iron golf club head 100 in that the shortest distance between a point P and second protrusion 1*f* is 10 mm or more, where point P is an intersection point between extension A of the central axis of hosel 20 and main body 10.

As shown in FIG. 8, the part of first protrusion 1*e* and second protrusion 1*f* located on the heel 10*c* side is remoter from heel 10*c* than that of iron golf club head 100 shown in FIG. 5. In other words, the part of first protrusion 1*e* and second protrusion 1*f* located on the heel 10*c* side is remoter from hosel 20 than that in FIG. 5.

The intersection point between extension A of the central axis of hosel 20 and main body 10 is denoted by P. The distance between intersection point P and the part of second protrusion 1*f* located on the heel 10*c* side is the shortest distance between intersection point P and second protrusion 1*f*. The shortest distance is 10 mm or more, particularly 15 mm or more, for example.

When the loft angle or lie angle is adjusted hosel 20 is subjected to relatively large stress. Accordingly, a heel-10*c*-side portion of the joint between face portion 1 and sole back portion 2, particularly of the joint between second protrusion 1*f* and end portion 2*b* of sole portion 17, is subjected to stress. The stress is greater as the shortest distance between intersection point P and second protrusion 1*f* is shorter.

For iron golf club head 100, the shortest distance between intersection point P and second protrusion 1*f* is not particularly limited. If iron golf club head 100 has only a small shortest distance between intersection point P and second protrusion 1*f*, the joint between face portion 1 and sole back portion 2 may be subjected to relatively large stress when the loft angle or lie angle is adjusted. This may cause damage (e.g., cracks) to the joint.

The shortest distance between intersection point P and second protrusion 1*f* of iron golf club head 101 is longer than that of iron golf club head 100. Accordingly, iron golf club head 101 is less likely to cause damage (e.g., cracks) to the joint between face portion 1 and sole back portion 2 due to the above-described stress, than iron golf club head 100.

The other construction of iron golf club head 101 is similar to that of iron golf club head 100, and thus iron golf club head 101 can bring about the advantageous effects similar to those of iron golf club head 100.

Embodiment 3

As shown in FIG. 9 to FIG. 12, an iron golf club head 102 according to embodiment 3 has a construction basically similar to that of iron golf club head 100 according to embodiment 1. However, iron golf club head 102 is different from iron golf club head 100 in that iron golf club head 102 includes a second hollow 4 located between ball striking surface 11 and first reverse surface 13, in addition to first hollow 3 located between ball striking surface 11 and second reverse surface 14.

The above-described ratio $W/V_1$, sole maximum width Sw, sweet spot height Sh, and ratio Sh/Fh of iron golf club head 102 are equal to those of iron golf club head 100.

Ratio $W/V_1$ (unit: $g/mm^3$) of weight W (unit: g) of iron golf club head 102 relative to volume $V_1$ (unit: $mm^3$) of iron golf club head 102 is $6.5\times10^{-3}$ or less. Preferably, ratio $W/V_1$ of iron golf club head 102 is 6.0 or less.

Sole maximum width Sw of iron golf club head 102 is 25 mm or more. Preferably, sole maximum width Sw of iron golf club head 102 is 27 mm or more.

Sweet spot height Sh of iron golf club head 102 is 20 mm or more. Preferably, sweet spot height Sh of iron golf club head 102 is 21 mm or more. More preferably, sweet spot height Sh of iron golf club head 102 is 23 mm or more.

Preferably, ratio Sh/Fh of sweet spot height Sh (unit: mm) relative to maximum value Fh (unit: mm) of the face height of face portion 1 of iron golf club head 102 is 0.33 or more. Maximum value Fh of the face height is preferably, but is not limited to, not less than 55 mm and not more than 64 mm.

Preferably, angle θ formed by first reverse surface 13 and second reverse surface 14 of iron golf club head 102 is 100 degrees or more. More preferably, angle θ is 150 degrees or less.

The weight of iron golf club head 102 is not less than 280 g and not more than 330 g. particularly not less than 290 g and not more than 310 g, for example.

Specific Example of Construction

First hollow 3 of iron golf club head 102 has a construction basically similar to that of the above-described first hollow 3 of iron golf club head 100, and is located between ball striking surface 11 and second reverse surface 14.

Second hollow 4 is located between ball striking surface 11 and first reverse surface 13. Second hollow 4 is located on the top edge 10*a* side relative to first hollow 3. Second hollow 4 is continuous with first hollow 3 and is separated from outside of iron golf club head 102. The volume of first hollow 3 is greater than the volume of second hollow 4.

First hollow 3 includes a first hollow segment 3*a* located on the heel 10*c* side, and a second hollow segment 3*b* located on the toe 10*d* side relative to first hollow segment 3*a* Second hollow 4 includes a third hollow segment 4*a* located on the heel 10*c* side, and a fourth hollow segment 4*b* located on the toe 10*d* side relative to third hollow segment 4*a*.

The sum of the volumes of first hollow segment 3*a* and third hollow segment 4*a* is greater than the sum of the volumes of second hollow segment 3*b* and fourth hollow segment 4*b*. The volume of first hollow segment 3*a* is greater than the volume of third hollow segment 4*a*.

The part of sole back portion 2 located between first hollow segment 3*a* and second reverse surface 14 is defined as a first portion. The part of sole back portion 2 located between second hollow segment 3*b* and second reverse surface 14 is defined as a second portion. The part of face portion 1 located between third hollow segment 4*a* and first reverse surface 13 is defined as a third portion. The part of face portion 1 located between fourth hollow segment 4*b* and first reverse surface 13 is defined as a fourth portion.

In the direction perpendicular to ball striking surface 11 (hereinafter referred to as a third direction), the maximum value of thickness 14 (see FIG. 11) of the fourth portion of face portion 1 is greater than the maximum value of thickness T3 (see FIG. 10) of the third portion of face portion 1. In the third direction, the maximum value of thickness T2 (see FIG. 11) of the second portion of sole back portion 2 is greater than the maximum value of thickness T1 (see FIG. 10) of the first portion of sole back portion 2.

Figure 10:
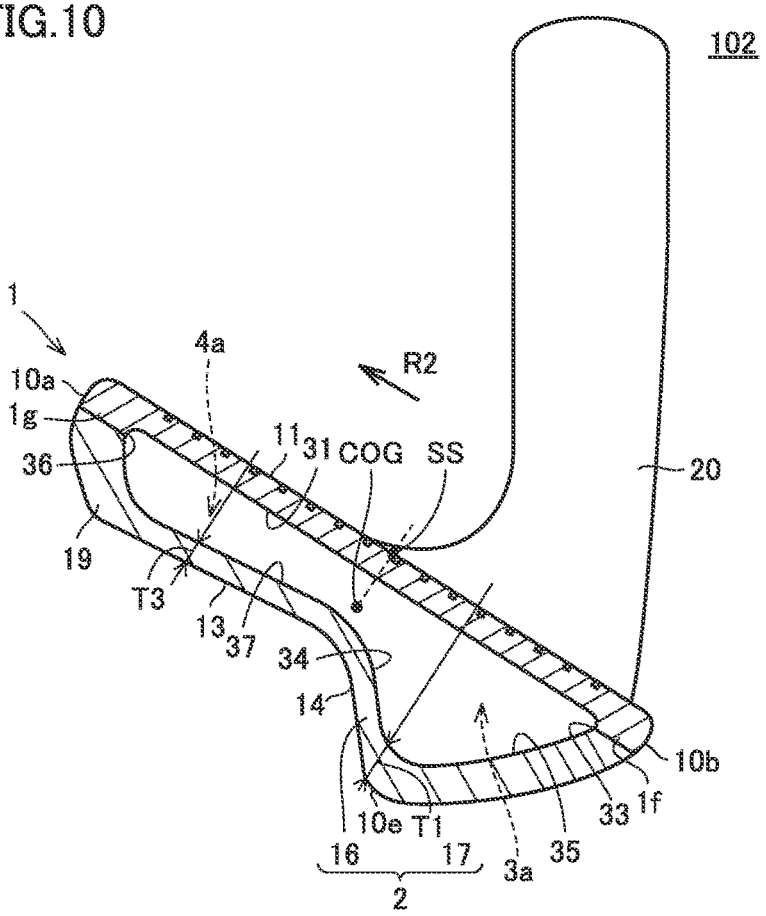
FIG. 10 is a cross-sectional view seen from line segment X-X in FIG. 9.
Figure 11:
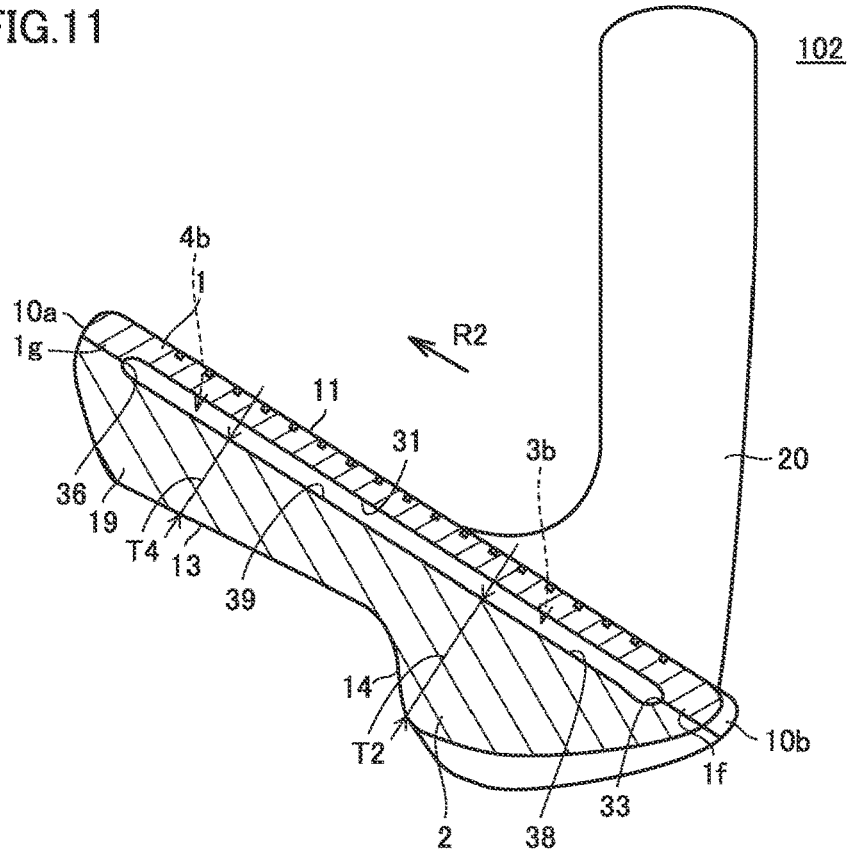
FIG. 11 is a cross-sectional view seen from line segment XI-XI in FIG. 9.

As shown in FIG. 10, the maximum value of thickness T1 of the first portion of sole back portion 2 is greater than the maximum value of thickness T3 of the third portion of face portion 1. As shown in FIG. 11, the maximum value of thickness T2 of the second portion of sole back portion 2 is greater than the maximum value of thickness T4 of the fourth portion of face portion 1.

The maximum value of thickness T4 of the fourth portion of face portion 1 is greater than the maximum value of thickness T1 of the first portion of sole back portion 2. The maximum value of thickness T4 of the fourth portion of face portion 1 is greater than the maximum value of the thickness of the part of face portion 1 located between ball striking surface 11 and first inner periphery 31. The maximum value of thickness T3 of the third portion of face portion 1 is, for example, smaller than the maximum value of the thickness of the part of face portion 1 located between ball striking surface 11 and first inner periphery 31. The thickness of the part of face portion 1 located between ball striking surface 11 and first inner periphery 31 is, for example, uniform in second direction R2.

In the third direction, the width of third hollow segment 4*a* is narrower than the width of first hollow segment 3*a*, and wider than the widths of second hollow segment 3*b* and fourth hollow segment 4*b*. The width of second hollow segment 3*b* in the third direction is, for example, equal to the width of fourth hollow segment 4*b* in the third direction.

Face portion 1 of iron golf club head 102 includes a second back portion 19 located on the back side relative to second hollow 4. Second back portion 19 is located on the top edge 10*a* side relative to the above-described back portion 16 (referred to as a first back portion 16 in the present embodiment) of sole back portion 2, and is continuous with first back portion 16. Second back portion 19 is located on the back side relative to first inner periphery 31. The end of second back portion 19 on the leading edge 10*b* side connects with the end of sole back portion 2 on the top edge 10*a* side.

Second back portion 19 includes first reverse surface 13, a sixth inner periphery 36, a seventh inner periphery 37, and a ninth inner periphery 39. Seventh inner periphery 37 is located opposite to first reverse surface 13, and faces a part of first inner periphery 31 located on the top edge 10*a* side, with third hollow segment 4*a* being interposed between seventh inner periphery 37 and the part of first inner periphery 31. Seventh inner periphery 37 is continuous with fourth inner periphery 34 of sole back portion 2. Ninth inner periphery 39 is located opposite to first reverse surface 13, and faces a part of first inner periphery 31 located on the top edge 10*a* side, with fourth hollow segment 4*b* being interposed between ninth inner periphery 39 and the part of first inner periphery 31. Ninth inner periphery 39 is continuous with (e.g., in the same plane as) an eighth inner periphery 38 of sole back portion 2. Sixth inner periphery 36 connects first inner periphery 31 with seventh inner periphery 37 or ninth inner periphery 39.

The thickness of the part of second back portion 19 that fronts on third hollow segment 4*a* is equal to or smaller than the thickness of the part of first back portion 16 that fronts on first hollow segment 3*a*. That is, the distance between first reverse surface 13 and seventh inner periphery 37 is equal to or shorter than the distance between second reverse surface 14 and fourth inner periphery 34. The thickness of the above-described portion of second back portion 19 that fronts on third hollow segment 4*a* is, for example, uniform in the second direction.

The thickness of the part of second back portion 19 that fronts on fourth hollow segment 4*b* is greater than the thickness of the part of second back portion 19 that fronts on third hollow segment 4*a*. That is, the distance between first reverse surface 13 and ninth inner periphery 39 is longer than the distance between first reverse surface 13 and seventh inner periphery 37. The thickness of the part of second back portion 19 that fronts on fourth hollow segment 4*b* increases from the leading edge 10*b* side toward top edge 10*a*.

Sole back portion 2 of iron golf club head 102 includes second reverse surface 14, second lower surface 15*b*, fourth inner periphery 34, fifth inner periphery 35, and eighth inner periphery 38. Eighth inner periphery 38 is located opposite to second reverse surface 14, and faces a part of first inner periphery 31 located on the leading edge 10*b* side, with second hollow segment 3*b* being interposed between eighth inner periphery 38 and the part of first inner periphery 31. Eighth inner periphery 38 is continuous with fourth inner periphery 34 and fifth inner periphery 35.

The thickness of sole back portion 2 in the third direction varies in the first direction. The thickness of sole back portion 2 located on the toe 10*d* side is greater than the thickness of sole back portion 2 located on the heel 10*c* side. The thickness of the part of sole back portion 2 that fronts on second hollow segment 3*b* is greater than the thickness of the part of sole back portion 2 that fronts on first hollow segment 3*a* in other words, the distance between second reverse surface 14 and eighth inner periphery 38 is longer than the distance between second reverse surface 14 and fourth inner periphery 34.

As the surfaces that front on first hollow 3, iron golf club head 102 mainly includes first inner periphery 31, third inner periphery 33, fourth inner periphery 34, fifth inner periphery 35, and eighth inner periphery 38. As the surfaces that front on second hollow 4, iron golf club head 102 mainly includes first inner periphery 31, sixth inner periphery 36, seventh inner periphery 37, and ninth inner periphery 39.

Iron golf club head 102 may be manufactured by any method. For example, iron golf club head 102 may be manufactured by welding a first member 5 and a second member 6 together. First member 5 and second member 6 are produced by, for example, forging or casting. An example construction of iron golf club head 102 manufactured by such a method is hereinafter described with reference to FIG. 9 to FIG. 12.

The part of iron golf club head 102 located on the front side relative to first hollow 3 and second hollow 4 is formed as one-piece first member 5, for example. The part of iron golf club head 102 located on the back side relative to first hollow 3 and second hollow 4 is formed as one-piece second member 6, for example. That is, second back portion 19 of face portion 1 and sole back portion 2 are formed as one-piece second member 6, for example.

First member 5 includes ball striking surface 11, first lower surface 15*a*, first inner periphery 31, third inner periphery 33, and sixth inner periphery 36. Second member 6 includes first reverse surface 13, second reverse surface 14, second lower surface 15*b*, fourth inner periphery 34, fifth inner periphery 35, seventh inner periphery 37, eighth inner periphery 38, and ninth inner periphery 39.

First member 5 further includes second protrusion 1*f* and a third protrusion 1*g*. First inner periphery 31 is surrounded by second protrusion 1*f* and third protrusion 1*g*. Second protrusion 1*f* and third protrusion 1*g* constitute one ring when seen from the direction perpendicular to ball striking surface 11. Third protrusion 1*g* protrudes relative to first inner periphery 31. Third protrusion 1*g* includes the above-described sixth inner periphery 36 fronting on first hollow 3. Sixth inner periphery 36 constitutes the inner periphery of third protrusion 1*g* and surrounds first inner periphery 31. The surface of third protrusion 1*g* opposite to sixth inner periphery 36 is exposed to outside, and constitutes the top surface of top edge 10*a*.

Second member 6 includes a ring-shaped portion 60 connected with the top surfaces of second protrusion 1*f* and third protrusion 1*g*. Second member 6 has a first recess portion 61 and a second recess portion 62 that are recessed relative to ring-shaped portion 60. First recess portion 61 is located on the heel 10*c* side relative to second recess portion 62. The part of the bottom surface of first recess portion 61 located on the leading edge 10*b* side constitutes fourth inner periphery 34 and fifth inner periphery 35. The part of the bottom surface of first recess portion 61 located on the top edge 10*a* side constitutes seventh inner periphery 37. The bottom surface of second recess portion 62 constitutes eighth inner periphery 38. The depth of second recess portion 62 relative to ring-shaped portion 60 is shallower than the depth of first recess portion 61 relative to ring-shaped portion 60.

Figure 12:
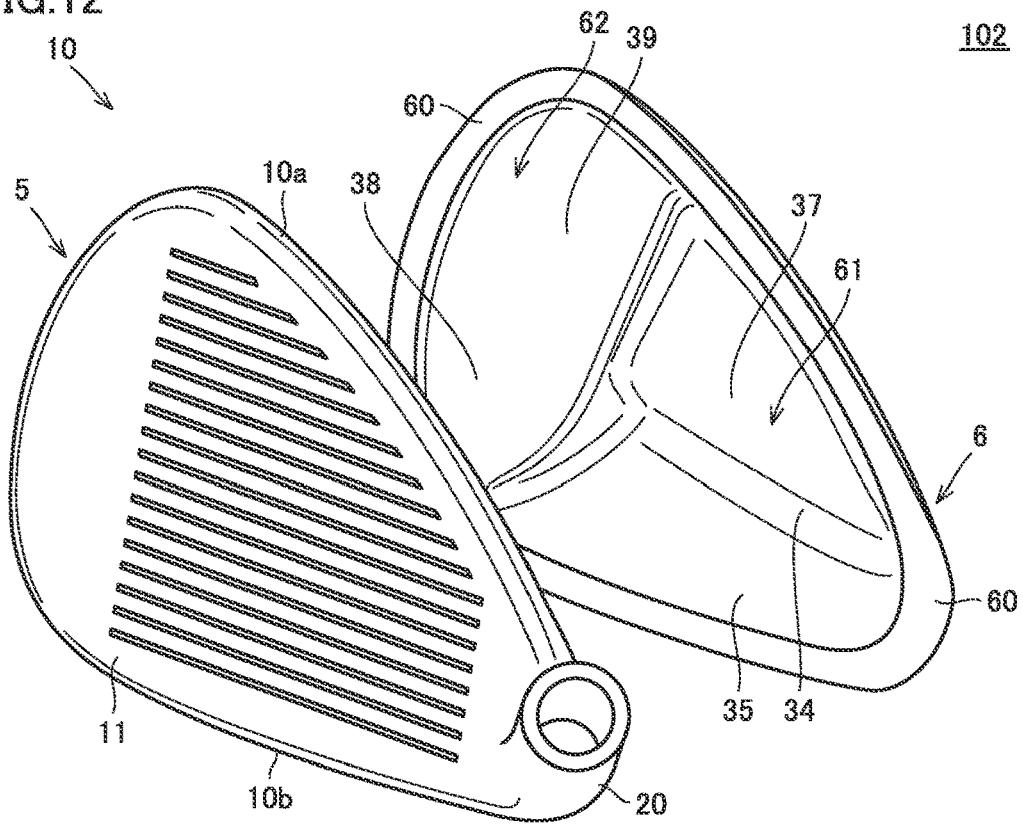
FIG. 12 is an exploded view of an iron golf club head according to embodiment 3.
Figure 13:
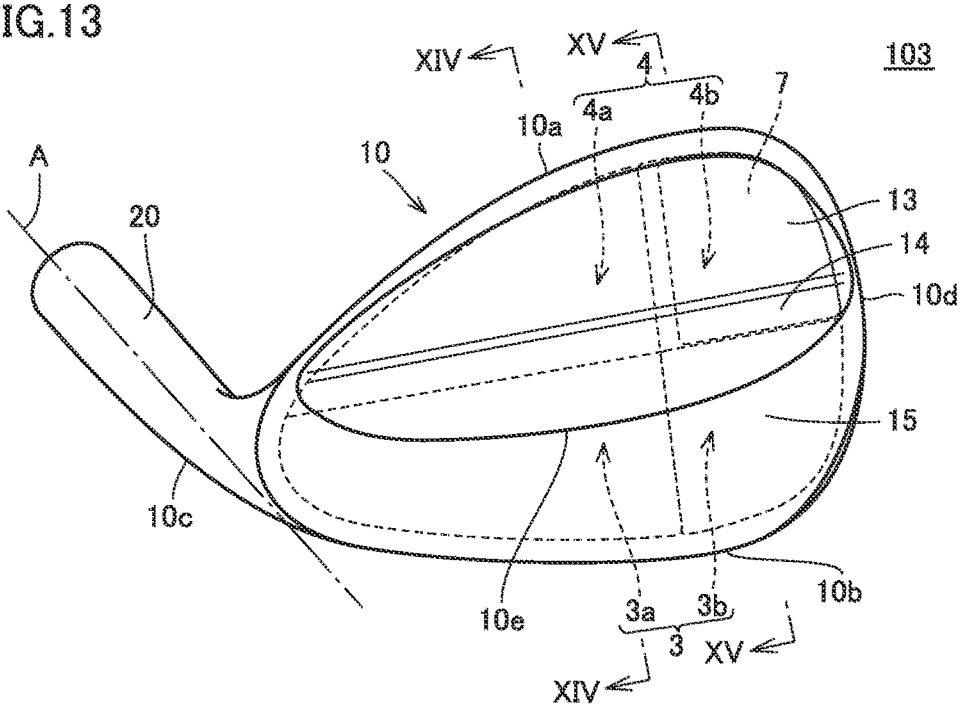
FIG. 13 is a rear view of an iron golf club head according to embodiment 4.
Figure 14:
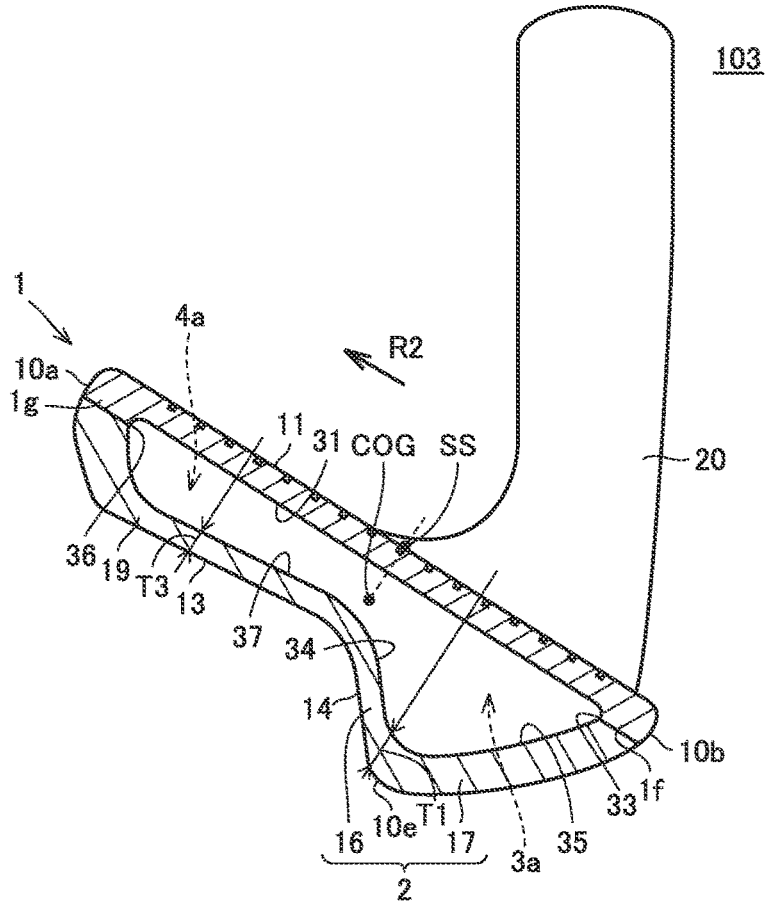
FIG. 14 is a cross-sectional view seen from line segment XIV-XIV in FIG. 13.
Figure 15:
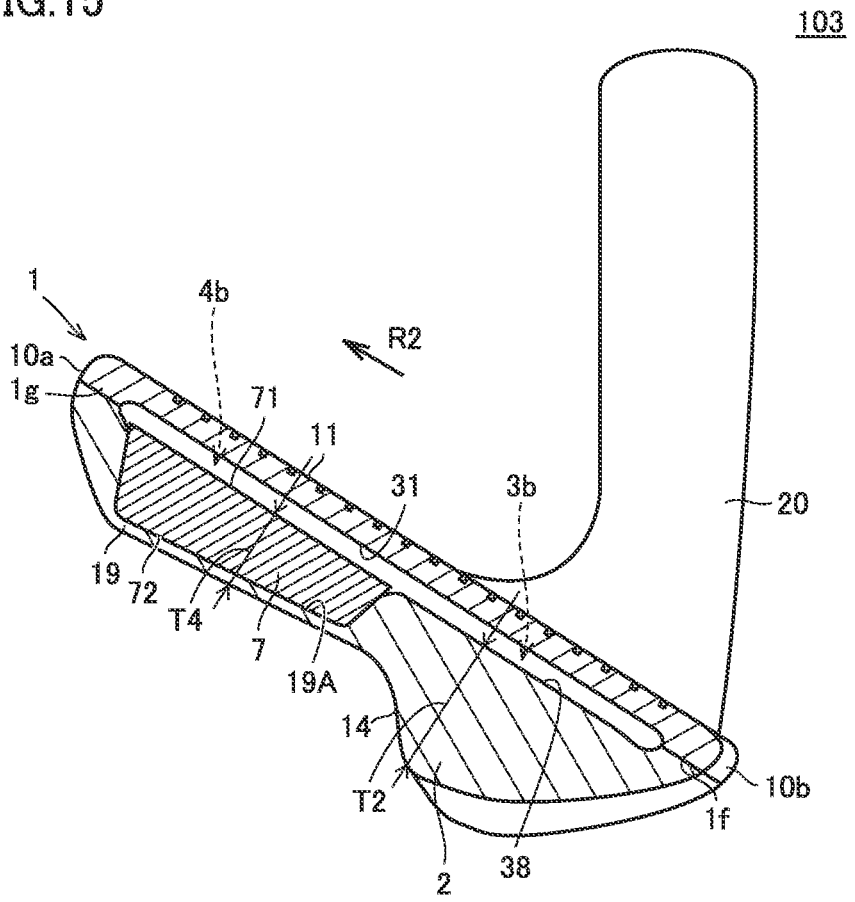
FIG. 15 is a cross-sectional view seen from line segment XV-XV in FIG. 13.
Figure 16:
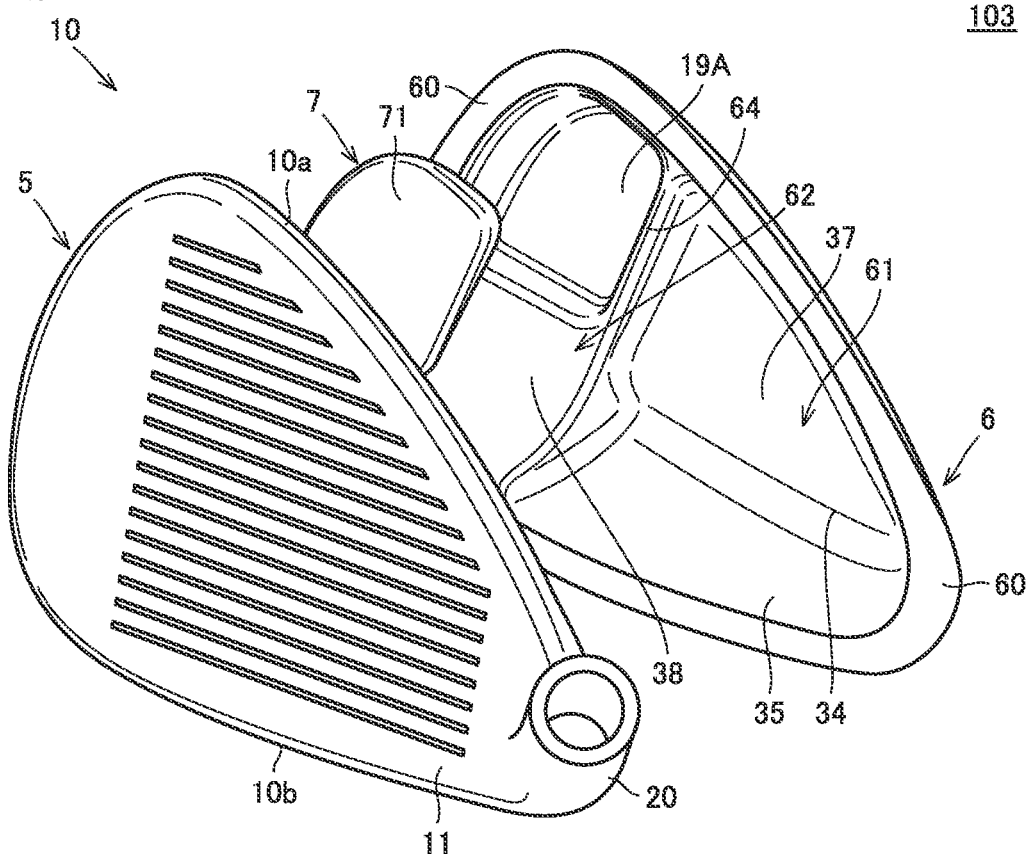
FIG. 16 is an exploded view of an iron golf club head according to embodiment 4.

As shown in FIG. 12, the lateral surface of first recess portion 61 that extends from the top edge 10*a* side to the leading edge 10*b* side is, for example, inclined toward toe 10*d* as getting closer to leading edge 10*b*.

Advantageous Effects

Since iron golf club head 102 has a construction basically similar to that of iron golf club head 100, iron golf club head 102 can bring about the advantageous effects similar to those of iron golf club head 100. The above-described iron golf club head 102 has a relatively large volume due to its sole portion with a relatively large width. However, an increase in weight of iron golf club head 102 is minimized because a part of its volume is composed of first hollow 3 and second hollow 4. Therefore, iron golf club head 102 glides smoothly at the time of a shot and is easy to use.

Further, unlike an iron golf club head having a cavity structure, iron golf club head 102 includes face portion 1 and sole back portion 2 that separate first hollow 3 and second hollow 4 from outside, and particularly includes second back portion 19 having the above-described first reverse surface 13, and first back portion 16 having the above-described second reverse surface 14. First back portion 16 and second back portion 19 are located on the back and upper side relative to sole portion 17 in the above-described reference position. Accordingly, iron golf club head 102 can be designed to have sweet spot height Sh of 20 mm or more without increasing maximum value Fh of the face height of face portion 1.

Sweet spot height Sh of iron golf club head 102 is higher than that of an iron golf club head having a cavity structure with no sole back portion 2. As a result, iron golf club head 102 can increase the amount of backspin as compared to the above-described iron golf club head having a cavity structure.

That is, as compared to the iron golf club head having a cavity structure where the sole maximum width is 22 mm or more and the above-described ratio is $7.43\times10^{-1}$ or more, iron golf club head 102 can achieve at least one of the weight reduction of main body 10 and the increase in the amount of backspin, while being as good as or better than the above-described iron golf club head in smoothness of glide at the time of a shot. Thus, iron golf club head 102 is improved in shot accuracy, while being as good as or better than the above-described iron golf club head in smoothness of glide at the time of a shot.

In iron golf club head 102, first hollow 3 includes first hollow segment 3*a* located on the heel side, and second hollow segment 3*b* located on the toe 10*d* side relative to first hollow segment 3*a* Second hollow 4 includes third hollow segment 4*a* located on the heel side, and fourth hollow segment 4*b* located on the toe 10*d* side relative to third hollow segment 4*a*. Thickness T4 of the fourth portion of face portion 1 is greater than thickness T3 of the third portion of face portion 1. Thickness T2 of the second portion of sole back portion 2 is greater than thickness T1 of the first portion of sole back portion 2.

The position of the center of gravity of such an iron golf club head 102 is located closer to toe 10*d* than that of iron golf club head 100 which has the same external shape as iron golf club head 102. Accordingly, the moment of inertia of iron golf club head 102 about the shaft is greater than that of iron golf club head 100. Therefore, the difference between the state in which a ball is struck at sweet spot SS and the state in which a ball is struck at a region deviating from sweet spot SS is smaller in iron golf club head 102 than in iron golf club head 100.

Embodiment 4

As shown in FIG. 13 to FIG. 16, an iron golf club head 103 according to embodiment 4 has a construction basically similar to that of iron golf club head 102 according to embodiment 3. However, iron golf club head 103 is different from iron golf club head 102 in that iron golf club head 103 further includes a high-density member 7.

The above-described ratio $W/V_1$, sole maximum width Sw, sweet spot height Sh, and ratio Sh/Fh of iron golf club head 103 are equal to those of iron golf club head 102.

Ratio $W/V_1$ (unit: $g/mm^3$) of weight W (unit: g) of iron golf club head 103 relative to volume $V_1$ (unit: $mm^3$) of iron golf club head 103 is $6.5\times10^{-3}$ or less. Preferably, ratio $W/V_1$ of iron golf club head 103 is 6.0 or less.

Sole maximum width Sw of iron golf club head 103 is 25 mm or more. Preferably, sole maximum width Sw of iron golf club head 103 is 27 mm or more.

Sweet spot height Sh of iron golf club head 103 is 20 mm or more. Preferably, sweet spot height Sh of iron golf club head 103 is 21 mm or more. More preferably, sweet spot height Sh of iron golf club head 103 is 23 mm or more.

Preferably, ratio Sh/h of sweet spot height Sh (unit: mm) relative to maximum value Fh (unit: mm) of the face height of face portion 1 of iron golf club head 103 is 0.33 or more. Maximum value Fh of the face height is preferably, but is not limited to, not less than 55 mm and not more than 64 mm.

Preferably, angle θ formed by first reverse surface 13 and second reverse surface 14 of iron golf club head 103 is 100 degrees or more. More preferably, angle θ is 150 degrees or less.

The weight of iron golf club head 103 is not less than 280 g and not more than 330 g, particularly not less than 290 g and not more than 310 g, for example.

Specific Example of Construction

First hollow 3 and second hollow 4 of iron golf club head 103 have constructions basically similar to those of the above-described hollow 3 and second hollow 4 of iron golf club head 102.

Second back portion 19 includes first reverse surface 13, sixth inner periphery 36, and seventh inner periphery 37.

Second back portion 19 has a third recess portion 19A between first reverse surface 13 and fourth hollow segment 4*b*, the third recess portion 19A fronting on fourth hollow segment 4*b*, for example. That is, third recess portion 19A is located on the toe 10*d* side of second back portion 19 in the first direction and on the top edge 10*a* side of second back portion 19 in the second direction. Third recess portion 19A is recessed relative to eighth inner periphery 38 of sole back portion 2. The depth of third recess portion 19A relative to ring-shaped portion 60 is, for example, deeper than the depth of first recess portion 61 relative to ring-shaped portion 60. The distance between the bottom surface of third recess portion 19A and first reverse surface 13, i.e., the thickness of the part of second back portion 19 located between the bottom surface of third recess portion 19A and first reverse surface 13, is uniform, for example. The top surface of third recess portion 19A is in the same plane as eighth inner periphery 38.

The thickness of second back portion 19 in the third direction varies in the first direction. The thickness of the part of second back portion 19 located between the bottom surface of third recess portion 19A and first reverse surface 13 is smaller than the thickness of the part of second back portion 19 located on the heel 10*c* side relative to third recess portion 19A. The thickness of the part of second back portion 19 located between the top surface of third recess portion 19A and first reverse surface 13 is greater than the thickness of the part of second back portion 19 located on the heel 10*c* side relative to third recess portion 19A in other words, the distance between first reverse surface 13 and a ninth inner periphery 71 of high-density member 7 is longer than the distance between first reverse surface 13 and seventh inner periphery 37.

Iron golf club head 103 further includes high-density member 7. High-density member 7 is located between first reverse surface 13 and fourth hollow segment 4*b*. High-density member 7 is located inside face portion 1, without being exposed at first reverse surface 13. High-density member 7 is located on the top edge 10*a* side relative to the center of iron golf club head 103 in the second direction. High-density member 7 is located on the toe 10*d* side relative to the center of iron golf club head 103 in the first direction.

High-density member 7 is fixed to second back portion 19. High-density member 7 is contained in third recess portion 19A. High-density member 7 is, for example, welded to third recess portion 19A. Any method may be used to fix high-density member 7 to third recess portion 19A. For example, high-density member 7 may be glued to third recess portion 19A. High-density member 7 includes ninth inner periphery 71 that faces first inner periphery 31, with fourth hollow segment 4*b* being interposed between ninth inner periphery 71 and first inner periphery 31, and a contact surface 72 in contact with the bottom surface of third recess portion 19A. Ninth inner periphery 71 is in the same plane as eighth inner periphery 38. The thickness of high-density member 7 in the third direction, i.e., the distance between ninth inner periphery 71 and contact surface 72, increases from the leading edge 10*b* side toward top edge 10*a* along second direction R2.

In iron golf club head 103, the fourth portion of face portion 1 located between fourth hollow segment 4*b* and first reverse surface 13 is composed of high-density member 7 and second back portion 19. Thickness T4 (see FIG. 15) of the fourth portion of face portion 1 is equal to the sum of the thickness of high-density member 7 and the thickness of second back portion 19 in the third direction. The magnitude relationship among the thicknesses of the first, second, third, and fourth portions of iron golf club head 103 is the same as that of iron golf club head 102.

The density of the material constituting high-density member 7 is higher than the density of the material constituting each of face portion 1 and sole back portion 2. The material constituting high-density member 7 includes, for example, tungsten (W).

Iron golf club head 103 may be manufactured by any method. For example, iron golf club head 103 may be manufactured by welding first member 5 to second member 6 having high-density member 7 fixed thereto. First member 5, second member 6, and high-density member 7 are produced by, for example, forging or casting.

For example, high-density member 7 is welded to second member 6. An example construction of iron golf club head 102 manufactured by such a method is hereinafter described with reference to FIG. 13 to FIG. 16.

The part of iron golf club head 103 located on the front side relative to first hollow 3 and second hollow 4 is formed as one-piece first member 5, for example.

The part of iron golf club head 103 located on the back side relative to first hollow 3 and second hollow 4 is formed as one-piece second member 6, for example. That is, second back portion 19 of face portion 1 and sole back portion 2 are formed as one-piece second member 6, for example.

First member 5 includes ball striking surface 11, first lower surface 15*a*, first inner periphery 31, third inner periphery 33, and sixth inner periphery 36. Second member 6 includes first reverse surface 13, second reverse surface 14, second lower surface 15*b*, fourth inner periphery 34, filth inner periphery 35, seventh inner periphery 37, and eighth inner periphery 38. High-density member 7 includes ninth inner periphery 71.

First member 5 further includes second protrusion 1*f* and third protrusion 1*g*. First inner periphery 31 is surrounded by second protrusion 1*f* and third protrusion 1*g*. Second protrusion 1*f* and third protrusion 1*g* constitute one ring when seen from the direction perpendicular to ball striking surface 11. Third protrusion 1*g* protrudes relative to first inner periphery 31. Third protrusion 1*g* includes the above-described sixth inner periphery 36 fronting on first hollow 3. Sixth inner periphery 36 constitutes the inner periphery of third protrusion 1*g* and surrounds first inner periphery 31. The surface of third protrusion 1*g* opposite to sixth inner periphery 36 is exposed to outside, and constitutes the top surface of top edge 10*a*.

Second member 6 includes ring-shaped portion 60 connected with the top surfaces of second protrusion 1*f* and third protrusion 1*g*. Second member 6 has first recess portion 61 and second recess portion 62 that are recessed relative to ring-shaped portion 60. First recess portion 61 is located on the heel 10*c* side relative to second recess portion 62. The part of the bottom surface or first recess portion 61 located on the leading edge 10*b* side constitutes fourth inner periphery 34 and fifth inner periphery 35. The part of the bottom surface of first recess portion 61 located on the top edge 10*a* side constitutes seventh inner periphery 37. The bottom surface of second recess portion 62 constitutes eighth inner periphery 38. The depth of second recess portion 62 relative to ring-shaped portion 60 is shallower than the depth of first recess portion 61 relative to ring-shaped portion 60.

Second member 6 further includes third recess portion 19A that is recessed relative to eighth inner periphery 38. The depth of third recess portion 194 relative to ring-shaped portion 60 is, for example, deeper than the depth of first recess portion 61 relative to ring-shaped portion 60.

As shown in FIG. 12, the lateral surface of first recess portion 61 that extends from the top edge 10*a* side to the leading edge 10*b* side is, for example, inclined toward toe 10*d* as getting closer to leading edge 10*b*.

Second member 6 includes a wall 64 that separates first recess portion 61 from third recess portion 19A. The top surface of wall 64 constitutes a part of the bottom surface of first recess portion 61. Wall 64 extends along the second direction. A part of the lateral surface of first recess portion 61 located on the top edge 10*a* side constitutes the wall surface of wall 64.

In iron golf club head 103, the thickness of high-density member 7 in the third direction gradually increases from the leading edge 10*b* side toward top edge 10*a* along second direction R2. However, this is not a limitation. The thickness of high-density member 7 in the third direction may increase stepwise from the leading edge 10*b* side toward top edge 10*a* along second direction R2.

Advantageous Effects

Since iron golf club head 103 has a constriction basically similar to that of iron golf club head 102, iron golf club head 103 can bring about the advantageous effects similar to those of iron golf club head 102.

Iron golf club head 103 further includes high-density member 7 located between first reverse surface 13 and fourth hollow segment 4*b*. The density of the material constituting high-density member 7 is higher than the density of the material constituting face portion 1 and sole back portion 2.

The weight of the part of iron golf club head 103 located between first reverse surface 13 and fourth hollow segment 4*b* is heavier than the weight of the part of iron golf club head 102 located between first reverse surface 13 and fourth hollow segment 4*b*. Accordingly, the position of the center of gravity of iron golf club head 103 is located closer to top edge 10*a* than that of iron golf club head 102. As a result, iron golf club head 103 increases the amount of backspin and further improves the shot accuracy, while being as good as or better than iron golf club head 102 in smoothness of glide at the time of a shot.

Further, the position of the center of gravity of iron golf club head 103 is located closer to top edge 10*a* than that of an iron golf club head in which a high-density member widely extends from top edge 10*a* to leading edge 10*b* on the toe 10*d* side. Thus, iron golf club head 103 increases the amount of backspin and further improves the shot accuracy, while being as good as or better than such an iron golf club head in smoothness of glide at the time of a shot.

In iron golf club head 103, the thickness of high-density member 7 in the direction perpendicular to ball striking surface 11 increases from the leading edge 10*b* side toward top edge 10*a*.

The position of the center of gravity of such an iron golf club head 103 is located closer to top edge 10*a* than that of an iron golf club head in which the thickness of high-density member 7 decreases from the leading edge 10*b* side toward top edge 10*a*, and than an iron golf club head in which the thickness of high-density member 7 is uniform in the second direction. Thus, iron golf club head 103 increases the amount of backspin and further improves the shot accuracy, while being as good as or better than such iron golf club heads in smoothness of glide at the time or a shot.

Examples

The above-described sweet spot height, sole maximum width, face height Fh, weight, and volume were measured for samples A to D and K to M as the present examples, and samples E to J as comparative examples.

Sample A has a construction equivalent to that of iron golf club head 100 according to embodiment 1. Samples B to D each have a construction equivalent to that of iron golf club head 101 according to embodiment 2. Samples K and L each have a construction equivalent to that of iron golf club head 102 according to embodiment 3. Sample M has a construction equivalent to that of iron golf club head 103 according to embodiment 4. In sample A, the shortest distance between extension A of the central axis of hosel 20 and second protrusion 1*f* was 6.15 mm. In samples B to D, the shortest distance between extension A of the central axis of hosel 20 and second protrusion 1*f* was 15.03 mm. Sample L had a greater sole maximum width Sw than sample K and weighed about 294 g. Sample M was differentiated from sample K by having a third recess portion and a high-density member fixed to the third recess portion. The high-density member of sample M had a volume of 2916.7 $mm^3$ and a weight of 43.8 g.

Samples E to J are iron golf club heads with a loft angle of 40 degrees or more and with no first hollow 3, unlike embodiments 1 and 2. Samples F to J, commercially available products, were substantially the same as samples A to D in sole maximum width Sw, face height Fh, and weight. In sample J, sole maximum width Sw is 25 mm or less. Samples F, G, and H each have a "cavity structure". Sample I includes a very shallow recess portion in the region extending from the sole portion to a face back surface on the heel side, the face back surface being the reverse side of the face portion located opposite to the ball striking surface. The recess portion of sample 1 includes a bottom portion and a top portion located on the back side relative to the bottom portion. The bottom and top portions extend from the heel to the position substantially intermediate between the heel and the toe, along the direction from the heel toward the toe. The bottom portion is located on the leading edge side relative to the top portion. Sample J has shallow grooves on its face back surface. The grooves of sample J extend in the direction from the heel toward the toe, and opens toward the top edge. Loft angle θ of each of samples A to E, G, and H is 56 degrees. Loft angle θ of each of samples F, I, J, and K to M is 58 degrees. In samples A to M, the angle formed by the first reverse surface and the second reverse surface is 100 degrees or more.

Table 1 shows the above-described sweet spot height (SS height) Sh, sole maximum width Sw, race height Sh, weight W, volume $V_1$, and volume $V_2$ of the hollow that were measured for samples A to M; and the above-described ratio $W/V_1$ and ratio Sh/Fh that were calculated based on these measurement results.

Table 2 shows the thicknesses of the parts of the face portion and sole back portion of each of samples A to D. The first thickness of the face portion in table 2 indicates the distance between ball striking surface 11 and first inner periphery 31. The second thickness of the face portion in table 2 indicates the distance between ball striking surface 11 and first reverse surface 13.

TABLE 1

| Sample | SS height Sh (mm) | Sole maximum projected width Sw (mm) | Face height Fh (mm) | Weight W (g) | Volume $V_1$ ($mm^3$) | Hollow volume $V_2$ ($mm^3$) | Ratio $W/V_1$ ($10^{-3}$ $g/mm^3$) | Ratio Sh/Fh |
|---|---|---|---|---|---|---|---|---|
| A | 21.73 | 27.6 | 607 | 292.6 | 50000 | 12264 | 5.85 | 0.358 |
| B | 23.46 | 28.0 | 62.8 | 294.0 | 51800 | 14373 | 5.67 | 0.374 |
| C | 23.88 | 28.0 | 62.8 | 276.4 | 51900 | 16723 | 5.32 | 0.380 |
| D | 22.86 | 28.0 | 62.8 | 328.7 | 51900 | 10058 | 6.33 | 0.364 |
| E | 21.08 | 28.0 | 61.9 | 386.8 | 49300 | — | 7.85 | 0.341 |
| F | 18.60 | 25.4 | 62.9 | 301.8 | 40600 | — | 7.43 | 0.296 |
| G | 18.26 | 29.3 | 61.8 | 305.3 | 41100 | — | 7.43 | 0.295 |
| H | 18.01 | 29.4 | 61.4 | 303.8 | 40800 | — | 7.45 | 0.293 |
| I | 17.18 | 25.0 | 62.2 | 301.2 | 40400 | — | 7.46 | 0.276 |
| J | 18.57 | 22.6 | 60.4 | 296.5 | 39800 | — | 7.45 | 0.307 |
| K | 21.91 | 25.0 | 60.7 | 272.6 | 48700 | 13706 | 5.60 | 0.361 |
| L | 22.80 | 26.7 | 60.7 | 293.0 | 52200 | 14668 | 5.61 | 0.376 |
| M | 22.62 | 25.0 | 60.7 | 293.8 | 48700 | 13706 | 6.04 | 0.373 |

TABLE 2

| Sample | Face portion first thickness (mm) | Face portion second thickness Minimum value (mm) | Face portion second thickness Maximum value (mm) | Sole portion thickness (mm) | Back portion thickness (mm) |
|---|---|---|---|---|---|
| A | 2.7 | 4.60 | 7.67 | 2.5 | 2.5 |
| B | 2.7 | 4.60 | 7.67 | 2.5 | 2.5 |
| C | 2.7 | 4.60 | 7.67 | 1.5 | 1.5 |
| D | 2.7 | 4.60 | 7.67 | 4.5 | 4.5 |
| E | 2.7 | 4.60 | 7.67 | — | — |

As shown in table 1, samples B to D have the same face height Fh and the same sole maximum width Sw. Face height Fh of sample A is lower than face height Fh of samples B to D. Sole maximum width Sw or sample A is smaller than sole maximum width Sw of samples B to D.

As shown in table 2, the thickness of each portion of sample A is equal to the thickness of a corresponding portion of sample B. In samples A to C, the thicknesses of the sole portion and back portion are smaller than the thickness of the part of the face portion located between the ball striking surface and the first inner periphery. In sample D, the thicknesses or the sole portion and back portion are greater than the thickness of the part of the face portion located between the ball striking surface and the first inner periphery. In sample C, the thicknesses of the sole portion and back portion are smaller than those of samples A and B.

As shown in table 1, in samples A to D and K to M, ratio $W/V_1$ was $6.5\times10^{-3}$ or less, sole maximum width Sw was 25 mm or more, and sweet spot height Sh was 20 mm or more. Also, in samples A to D and K to M, volume $V_2$ of the hollow was 18000 $mm^3$ or less, ratio Sh/Fh was 0.33 or more, and the weight was 330 g or less.

On the other hand, the weight of sample F was well over 330 g. With reference to sample E, in order to design an iron golf club head with no hollow to have sweet spot height Sh of 20 mm or more, while its sole maximum width Sw and face height Fh are substantially the same as those of samples A to D and K to M, the iron golf club head required a much greater weight on its top edge side and its hosel than samples A to D and K to M. It was confirmed that an iron golf club head like sample E is less easy to use than samples A to L and K to M.

Sweet spot height Sh or each of samples F to J was less than 20 mm, specifically, less than 19 mm. This shows that samples A to D and K to M are as good as or better than samples E to J in smoothness of glide at the time of a shot, and are improved in shot accuracy compared to samples F to J.

It should be understood that the embodiments of the present invention disclosed herein are by way of example in every respect, not by way of limitation. The scope of the present invention is defined by the terms of the claims, and is intended to include any modification within the meaning and scope equivalent to the terms or the claims.

What is claimed is:

1. An iron golf club head with a loft angle of 40 degrees or more, comprising:

a face portion including a ball striking surface and a first reverse surface located opposite to the ball striking surface; and a sole back portion including a second reverse surface connected with the first reverse surface and located below the first reverse surface when the iron golf club head is placed on a horizontal plane in such a manner that each of the loft angle and a lie angle of the iron golf club head is a predetermined angle, the iron golf club head having a first hollow separated from outside by the face portion and the sole back portion, a ratio $W/V_1$ of a weight W (unit: g) of the iron golf club head relative to a volume $V_1$ (unit: $mm^3$) of the iron golf club head being $6.5\times10^{-3}$ or less, a sole maximum projected width Sw of the iron golf club head being 25 mm or more, a sweet spot height Sh of the iron golf club head being 20 mm or more, and wherein a ratio Sh/Fh of the sweet spot height Sh (unit: mm) relative to a maximum value Fh (unit: mm) of a face height of the face portion is 0.33 or more.

2. The iron golf club head according to claim 1, further comprising a second hollow continuous with the first hollow and separated from outside, wherein the second hollow is located between the ball striking surface and the first reverse surface.

3. The iron golf club head according to claim 2, wherein the first hollow includes a first hollow segment located on a heel side, and a second hollow segment located on a toe side relative to the first hollow segment, the second hollow includes a third hollow segment located on the heel side and a fourth hollow segment located on the toe side relative to the third hollow segment, a thickness of a part of the face portion located between the fourth hollow segment and the first reverse surface in a direction perpendicular to the ball striking surface is greater than a thickness of a part of the face portion located between the third hollow segment and the first reverse surface, and a thickness of a part of the sole back portion located between the second hollow segment and the second reverse surface is greater than a thickness of a part of the sole back portion located between the first hollow segment and the second reverse surface.

4. The iron golf club head according to claim 3, further comprising a high-density member located between the first reverse surface and the fourth hollow segment, wherein a density of a material constituting the high-density member is higher than a density of a material constituting the face portion and the sole back portion.

5. The iron golf club head according to claim 4, wherein a thickness of the high-density member in the direction perpendicular to the ball striking surface increases from a leading edge side toward a top edge.

6. The iron golf club head according to claim 1, wherein the first hollow is located between the ball striking surface and the second reverse surface.

7. The iron golf club head according to claim 6, further comprising a second hollow continuous with the first hollow and separated from outside, wherein the second hollow is located between the ball striking surface and the first reverse surface.

8. The iron golf club head according to claim 7, wherein the first hollow includes a first hollow segment located on a heel side, and a second hollow segment located on a toe side relative to the first hollow segment, the second hollow includes a third hollow segment located on the heel side and a fourth hollow segment located on the toe side relative to the third hollow segment, a thickness of a part of the face portion located between the fourth hollow segment and the first reverse surface in a direction perpendicular to the ball striking surface is greater than a thickness of a part of the face portion located between the third hollow segment and the first reverse surface, and a thickness of a part of the sole back portion located between the second hollow segment and the second reverse surface is greater than a thickness of a part of the sole back portion located between the first hollow segment and the second reverse surface.

9. The iron golf club head according to claim 8, further comprising a high-density member located between the first reverse surface and the fourth hollow segment, wherein a density of a material constituting the high-density member is higher than a density of a material constituting the face portion and the sole back portion.

10. The iron golf club head according to claim 9, wherein a thickness of the high-density member in the direction perpendicular to the ball striking surface increases from a leading edge side toward a top edge.

11. An iron golf club head with a loft angle of 40 degrees or more, comprising:

a face portion including a ball striking surface and a first reverse surface located opposite to the ball striking surface; and a sole back portion including a second reverse surface connected with the first reverse surface and located below the first reverse surface when the iron golf club head is placed on a horizontal plane in such a manner that each of the loft angle and a lie angle of the iron golf club head is a predetermined angle, the iron golf club head having a first hollow separated from outside by the face portion and the sole back portion, a ratio $W/V_1$ of a weight W (unit: g) of the iron golf club head relative to a volume $V_1$ (unit: $mm^3$) of the iron golf club head being $6.5\times10^{-3}$ or less, a sole maximum projected width Sw of the iron golf club head being 25 mm or more, a sweet spot height Sh of the iron golf club head being 20 mm or more, and wherein an angle formed by the first reverse surface and the second reverse surface is 100 degrees or more.

12. An iron golf club head with a loft angle of 40 degrees or more, comprising:

a face portion including a ball striking surface and a first reverse surface located opposite to the ball striking surface; and a sole back portion including a second reverse surface connected with the first reverse surface and located below the first reverse surface when the iron golf club head is placed on a horizontal plane in such a manner that each of the loft angle and a lie angle of the iron golf club head is a predetermined angle, the iron golf club head having a first hollow separated from outside by the face portion and the sole back portion, a ratio $W/V_1$ of a weight W (unit: g) of the iron golf club head relative to a volume $V_1$ (unit: $mm^3$) of the iron golf club head being $6.5\times10^{-3}$ or less, a sole maximum projected width Sw of the iron golf club head being 25 mm or more, a sweet spot height Sh of the iron golf club head being 20 mm or more, wherein the first hollow is located between the ball striking surface and the second reverse surface, a second hollow continuous with the first hollow and separated from outside, wherein the second hollow is located between the ball striking surface and the first reverse surface.

13. The iron golf club head according to claim 12, wherein the first hollow includes a first hollow segment located on a heel side, and a second hollow segment located on a toe side relative to the first hollow segment, the second hollow includes a third hollow segment located on the heel side and a fourth hollow segment located on the toe side relative to the third hollow segment, a thickness of a part of the face portion located between the fourth hollow segment and the first reverse surface in a direction perpendicular to the ball striking surface is greater than a thickness of a part of the face portion located between the third hollow segment and the first reverse surface, and a thickness of a part of the sole back portion located between the second hollow segment and the second reverse surface is greater than a thickness of a part of the sole back portion located between the first hollow segment and the second reverse surface.

14. The iron golf club head according to claim 13, further comprising a high-density member located between the first reverse surface and the fourth hollow segment, wherein a density of a material constituting the high-density member is higher than a density of a material constituting the face portion and the sole back portion.

15. The iron golf club head according to claim 14, wherein a thickness of the high-density member in the direction perpendicular to the ball striking surface increases from a leading edge side toward a top edge.

* * * * *